United States Patent [19]

Ting et al.

[11] Patent Number: 4,855,571

[45] Date of Patent: Aug. 8, 1989

[54] POSITIVE TEMPERATURE COEFFICIENT CERAMIC HEATING ELEMENT FOR HEATING A FLUID

[75] Inventors: Ching-Jui Ting; Cheng-Jien Peng, both of Hsin-Chu, Taiwan

[73] Assignee: Industrial Technology Research Institute, Hsinchu, Taiwan

[21] Appl. No.: 150,785

[22] Filed: Jan. 29, 1988

[51] Int. Cl.[4] ..... H05B 3/10; F24H 3/04; F24H 1/10; H01C 7/02

[52] U.S. Cl. ..... 219/376; 219/307; 219/338; 219/381; 219/539; 219/541; 338/22 R; 338/295; 338/320; 338/333

[58] Field of Search ..... 219/504, 505, 374–376, 219/381–382, 370, 532, 205–207, 538, 539, 541, 306, 307, 338; 338/22 R, 295, 320, 333

[56] References Cited

U.S. PATENT DOCUMENTS

| | | | |
|---|---|---|---|
| 1,982,382 | 11/1934 | Gumdelfinger | 219/375 X |
| 3,492,457 | 1/1970 | Subt | 219/376 X |
| 3,775,590 | 11/1973 | Gartner | 219/381 X |
| 3,927,300 | 12/1975 | Wada et al. | 219/381 |
| 4,162,395 | 7/1979 | Kobayashi et al. | 219/504 X |
| 4,232,214 | 11/1980 | Shioi et al. | 219/381 X |
| 4,585,924 | 4/1986 | Pakula | 219/205 |
| 4,703,153 | 10/1987 | Pelonis | 219/376 X |

FOREIGN PATENT DOCUMENTS

| | | | |
|---|---|---|---|
| 56-12950 | 2/1981 | Japan | 219/375 |

*Primary Examiner*—Anthony Bartis
*Attorney, Agent, or Firm*—Ladas & Parry

[57] ABSTRACT

An electric resistance heating element for heating fluids includes a plurality of ring-shaped members made of a ceramic material having a positive temperature coefficient (PTC) disposed in concentric generally coplanar relationship, one around the other, and spaced apart from each other to form through passages for fluid flow therebetween. Electrode layers are formed at the two opposite ends of each ring and a pair of electrically conductive securing ring members are each securely soldered to a respective one of the electrode layers. Each securing ring member is integrally formed with two diametrical cross members soldered to each ceramic ring-shaped members and with each cross member having spaced grooves radially engaging and positioning the ring-shaped ceramic members. The outer periphery of each securing ring member incorporates a plurality of radially extending lugs for mounting the heating element for use and for making electrical connection between the securing ring member and a power supply.

9 Claims, 3 Drawing Sheets

POSITIVE TEMPERATURE COEFFICIENT CERAMIC HEATING ELEMENT FOR HEATING A FLUID

BACKGROUND OF THE INVENTION

This invention relates to a heating element having positive temperature coefficient (PTC) ceramic heating units used for heating a fluid such as air, and particularly to a heating element which has ring-shaped PTC ceramic heating units having encircling walls disposed one in the other with their encircling walls spaced apart from each other.

It is known that PTC ceramic material made of semiconductive barium titanate is used as a heating element. A very common construction of the PTC ceramic heating element is in the form of a disc which has less heat radiation surface. This construction is not economical since a large number of heating elements is required to produce high wattage. U.S. Pat. No. 3,927,300 discloses a honeycomb-shaped PTC ceramic element which has a high surface to volume ratio and can generate a large amount of heat radiation. However, to manufacture such a kind of PTC ceramic heating element, a complex process is needed to make molds, and the particle size of the raw material for forming the honeycomb ceramic element must be prepared properly to obtain a particular size distribution. Also the extrusion process for forming the honeycomb-shaped structure is difficult and may cause a large percentage of defective products. In application, such a honeycomb structure, in many cases, can not achieve a uniform voltage due to its non-uniform resistance caused by disuniform temperatures throughout its body.

U.S. Pat. No. 4.162,395 discloses a heating element which includes a plurality of PTC ceramic plates each having four corners and each being spaced apart parallelly from the other. Each PTC ceramic plate is provided with two thin-layer electrodes at its two opposite sides, and all the plates are interconnected by four separate metal corner bars of L-shaped cross-section each of which is welded to one of the corners of all the plates, forming a construction having eight corners. A U-shaped plate is used to house all the interconnected plates. While the PTC ceramic plates can be easily formed, the construction having these plates is still disadvantageous due to its limitation to a configuration having eight corners in which each plate has four corners, thereby restricting the selection of different dimensions and shapes to suit different heating devices. In addition, the assembly of parallel PTC ceramic plates requires a housing member to firmly secure them together or to reinforce the construction thereof, and the heat radiation surfaces provided by these parallel PTC ceramic plates are inefficient.

SUMMARY OF THE INVENTION

It is an object of the invention to provide a heating element having PTC ceramic heating elements which can be formed easily and which provide a large total heat radiation surface.

It is another object of the invention to provide a heating element having PTC ceramic heating elements which can be easily assembled into a strong construction with a minimum number of securing pieces.

According to the present invention, a heating element includes a plurality of ring-shaped members having encircling walls made of PTC ceramic and disposed one around the other spaced apart from each other. These ring-shaped members can easily be formed individually and the assembly thereof provide more heat radiation surface area than that of the parallel PTC ceramic plates described hereinbefore. The ring-shaped members may be in a form having a rectangular cross-section, an elliptical cross-section, a polygonal cross-section or the like so that the assembly of the ring-shaped members can have a wider range of selection for various configurations than that of the afore-mentioned parallel plates.

Besides the above-described benefits, the present invention also provides an advantage in that the means for securing and positioning the ring-shaped ceramic members can include a fewer number of separate pieces than that required by the parallel PTC ceramic plates, and no housing means is required according to the present invention, unlike the construction of the parallel plates.

In one aspect of the invention, the means for securing the ring-shaped ceramic members includes two separate securing members which are mounted respectively and securely on two opposite ends of the outermost one of the ceramic ring-shaped members, and at least one diametrical cross-member which is of one piece with each securing ring member and has positioning grooves spaced apart radially to engage with the ends of all of the ring-shaped ceramic members excluding the outermost ring-shaped ceramic members, said securing ring members are respectively in electrical connection with the layers of electrodes formed on the ends of the ring-shaped ceramic members.

In another aspect of the invention, each securing ring member has lug members which extend radially from the securing rings and has attachment holes therein. These lug members are used for mounting the element of the present invention on other apparatus in which the invention is to be incorporated as well as for making electrical connection for the invention.

In still another aspect of the invention, the securing ring members have a contour conforming to that of the end of the outermost ceramic ring-shaped member, and an L-shaped cross-section in an axial plane of the securing ring member. The securing ring members are bonded securely to the layers of electrode formed on the ends of the ring-shaped ceramic members.

The present exemplary preferred embodiment will be described in detail with reference to the following drawings, in which:

DETAILED DESCRIPTION OF THE PREFERRED EMBODIMENTS

Referring to FIGS. 1 through 4, a heating element 10 is shown, including a plurality of ring-shaped members 1*a*, 1*b*, 1*c*, and 1*d* which have circular walls with different diameters and are made of positive temperature coefficient (PTC) ceramic material. The walls of the ring-shaped members are disposed concentrically one around the other and spaced apart from each other to form through-passages therebetween. A central cylindrical member 1*e* also made of the PTC ceramic material is disposed within the member 1*d*. The space between the walls of adjacent ring-shaped members and the thickness of the members may be arranged according to the size of the whole assembly of the heating element. If the diameter of the ring-shaped members is large, the thickness thereof must be increased to increase the strength of the ring-shaped members. If the spacing is small, the efficiency of the heating element will be increased.

At two ends of the circular wall of each of ring-shaped members 1*a*, 1*b*, 1*c* and 1*d* and the central member 1*e* are respectively provided ohmic electrodes 2*a* and 2*b*, for example silver electrodes, by electroplating or any one of the other known methods.

The ring-shaped members 1*a*, 1*b*, 1*c* and 1*d* and the central member 1*e* with electrodes 2*a* and 2*b* are secured together by means of a securing means which includes two circular metal rings 3*a* and 3*b* secured respectively to two ends of the outermost ring-shaped member 1*a*, and a pair of diametral cross-members 4*a* and 4*b* integrally formed with each of circular metal rings 3*a* and 3*b* and connected to the ends of the ring-shaped members 1*b*, 1*c*, 1*d* and the central member 1*e*. The connection between the securing means and the ceramic members 1*a*, 1*b*, 1*c*, 1*d* and 1*e* are accomplished by soldering the securing means to the electrodes 2*a* and 2*b*.

Preferably, the securing rings 3*a* and 3*b* have a cross-section of L-shape in an axial plane of the ring-shaped member 1*a* so that it has a shoulder formation to engage with the corner of the ring-shaped member 1*a*. The diametrical cross-members 4*a* and 4*b* of the securing ring 3*a* are welded to electrodes 2*a* of inner ring-shaped members 1*b*, 1*c* and 1*d* and the central member 1*e*. The diametral cross-members 4*a* and 4*b* of the metal ring 3*b* are welded to electrodes 2*b* of inner ring-shaped members 1*b*, 1*c* and 1*d* and the central member 1*e*. Radially spaced apart grooves 4*c* are provided in the cross-members 4*a* and 4*b* for positioning the ring-shaped members. These grooves 4*c* respectively engage with the ends of the ring-shaped ceramic members 1*b*, 1*c*, 1*d* and 1*e*, thereby increasing the bonding between the cross-members and the ring-shaped ceramic members. Radially extending lugs 5 with holes 5*a* are formed on the other periphery of the securing rings 4*a* and 4*b* to be used as mounting members and electrical connectors.

Figure 1:
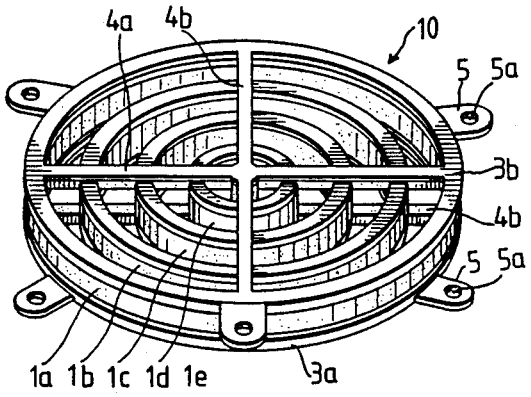
FIG. 1 is a perspective view of a preferred embodiment of the present invention.
Figure 2:
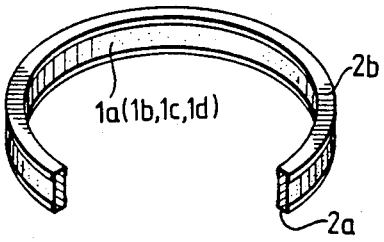
FIG. 2 is a fragmentary view showing one of the ring-shaped ceramic members and electrodes provided thereon.
Figure 3:
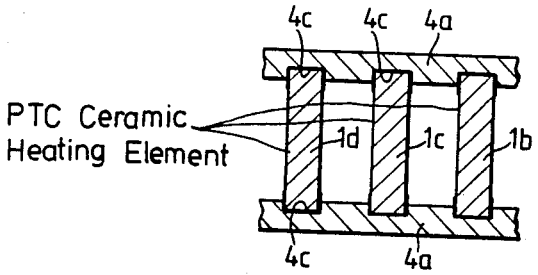
FIG. 3 is a fragmentary sectional view showing the connection between a diametrical cross-member and the ring-shaped ceramic members.
Figure 4:
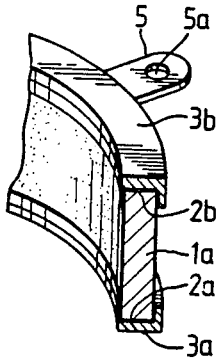
FIG. 4 is a fragmentary view showing the connection between the securing rings and the outmost ring-shaped ceramic member.
Figure 5:
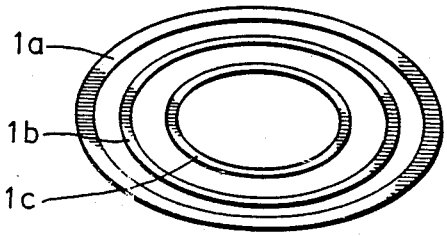
FIG. 5 is a plan view showing elliptical ceramic members.
Figure 6:
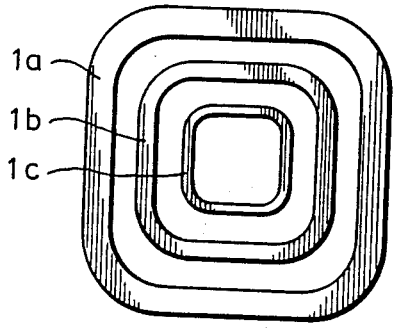
FIG. 6 is a plan view showing rectangular ceramic members.
Figure 7:
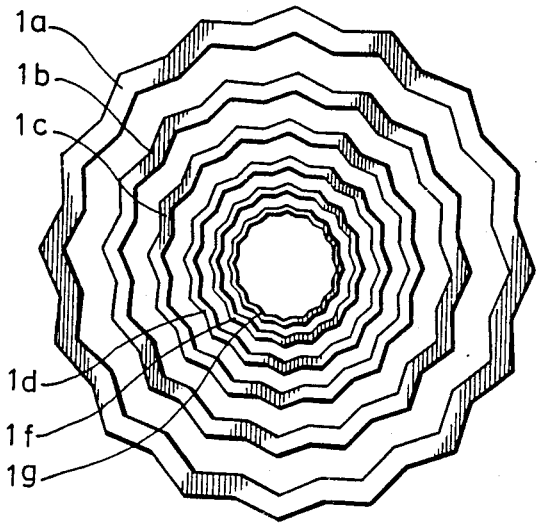
FIG. 7 is a plan view showing the ring-shaped members with wavy surfaces.

While the ring-shaped PTC ceramic heating members of the above-described embodiment have a circular shape, the invention is not limited thereto. Besides the circular shape, the PTC ceramic heating members according to the present invention may be in the form of any one of those having an elliptic cross-section as shown in FIG. 5, a rectangular cross section as shown in FIG. 6, and the like. Moreover, the ring-shaped PTC ceramic members of the present invention can be constructed in such a manner that they have heat radiation surfaces with indentations and projections, for example wavy surfaces, to increase their heat radiation surface area. The surfaces can be provided at either one or both of the inner and outer sides of the ring-shaped ceramic members. FIG. 7 shows the ring-shaped ceramic members having wavy surfaces at both the inner and outer sides thereof.

With the invention thus explained, it is apparent that various modifications and variations can be made without departing from the scope of the invention. It is therefore intended that the invention be limited only as indicated in the appended claims.

What I claim is:

1. A heating element for heating fluids comprising:

a plurality of ring-shaped members made of a ceramic material having a positive temperature coefficient (PTC) and disposed in concentrically spaced, generally coplanar relationship one around the other, said ring-shaped members having encircling walls spaced apart from each other to form through-passages therebetween, each of said ring-shaped members having a first end and a second end opposite to said first end;

an electrode layer formed on and electrically connected to each of said first end and said second end of each of said ring-shaped members; and means for securing said ring-shaped ceramic members in said concentric spaced relationship, said securing means being connected securely to all of said ring-shaped members and including two conductive securing members which are spaced apart from one another and one of which is in electrical connection with said electrodes formed on all of said first ends and the other of which is in electrical connection with said electrodes formed on all of said second ends of said ring-shaped members, said securing embers incorporating means cooperating with said ring-shaped members for spacing and positioning said ring-shaped ceramic members.

2. A heating element as claimed in claim 1, wherein said securing means further incorporate a mounting means for mounting said ring-shaped ceramic members for use, and an electric connector used for making electrical connection to a power supply.

3. A heating element for heating fluids comprising:

a plurality of ring-shaped members made of a ceramic material having a positive temperature coefficient (PTC) and disposed in concentrically spaced, generally coplanar relationships one around the other, said ring-shaped ceramic members having encircling walls spaced apart from each other to form through-passages therebetween, each of said ring-shaped members having a first end and a second end opposite to said first end;

an electrode layer formed on and electrically connected to each of said first end and said second end of each of said ring-shaped members; and means for securing said ring-shaped ceramic members in said concentric spaced relationship including two conductive securing ring members each being mounted securely respectively on one of said first and second ends of the outermost one of said ceramic ring-shaped members, a diametrical conductive cross-member connected integrally to each of said securing ring members and each connected respectively to said first ends and said second ends of all of said ring-shaped ceramic members inwardly of said outermost ring ceramic member, said securing ring members being respectively in electrical connection with said electrode layers.

4. A heating element as claimed in claim 3, wherein each of said securing ring members has lug members extending radially from said each securing ring member for mounting the heating element for use, said lug members having attachment holes therein.

5. A heating element as claimed in claim 3, wherein each of said securing ring members has a contour conforming to that of said first end or second end of said outermost ceramic ring-shaped member and an L-shaped cross-section in an axial plane of said each securing ring member, said each securing ring member being bonded securely to one of said electrode layers, and each of said diametrical cross-members has grooves which are spaced apart radially to engage with said ring-shaped members.

6. A heating element as claimed in claim 3, wherein said ring-shaped ceramic members have a rectangular shape.

7. A heating element as claimed in claim 3, wherein said ring-shaped ceramic members have a elliptical shape.

8. A heating element as claimed in claim 3, wherein said ring-shaped ceramic members have a circular shape.

9. A heating element as claimed in claim 3, wherein the encircling walls of each ring-shaped member has a heat radiation surface which has indentations and projections.

* * * * *